US006981462B2

(12) United States Patent
Dyer

(10) Patent No.: US 6,981,462 B2
(45) Date of Patent: Jan. 3, 2006

(54) FINS ON TROLLING PLATE MOUNT

(76) Inventor: William B. Dyer, 3358 Taylor Rd., Central Point, OR (US) 97502

( * ) Notice: Subject to any disclaimer, the term of this patent is extended or adjusted under 35 U.S.C. 154(b) by 25 days.

(21) Appl. No.: 10/846,858

(22) Filed: May 17, 2004

(65) Prior Publication Data

US 2005/0252434 A1 Nov. 17, 2005

(51) Int. Cl.
*B63H 25/44* (2006.01)

(52) U.S. Cl. ..... 114/145 A

(58) Field of Classification Search ..... 114/145 A, 114/145 R, 274; 440/900, 66, 67, 71, 72
See application file for complete search history.

(56) References Cited

U.S. PATENT DOCUMENTS

| | | | | |
|---|---|---|---|---|
| 5,127,353 | A | 7/1992 | Wieser | 114/145 |
| 5,178,089 | A | 1/1993 | Hodel | 114/274 |
| 5,203,275 | A | 4/1993 | Brauner et al. | 114/274 |
| 5,493,990 | A | 2/1996 | Dyer | 114/145 |

*Primary Examiner*—Ed Swinehart
(74) *Attorney, Agent, or Firm*—James D. Givnan, Jr.

(57) ABSTRACT

Horizontally disposed fins are located in a plane in alignment with a raised trolling plate with fin trailing edges proximate the leading edge of the raised trolling plate. A mounting bracket of a trolling plate assembly serves to mount the fins superjacent the anti-cavitation plate of a propulsion unit.

4 Claims, 1 Drawing Sheet

1
17
20
22
23
24
21
25
5
14
11
13
15
6
8
9
7
3
10
12
4
2
18

28
16
5A
7A
7

FINS ON TROLLING PLATE MOUNT

BACKGROUND OF THE INVENTION

The present invention is directed toward fins on a watercraft propulsion unit to enhance operation of the watercraft during acceleration and at speed.

During acceleration of a boat of the type and size used in towing water skiers or like recreational purposes, it is common for the craft to assume a bow high attitude when starting which hinders the operator's forward vision. A bow high attitude is also undesirable in that it slows the rate of acceleration.

In recreational boating it is common to utilize a boat for both the towing of skiers, inner tube riders, etc., and for fishing. Such boats are frequently equipped with a trolling plate unit on an outdrive or the lower unit of an outboard motor. Trolling plates serve to reduce propeller efficiency or other propulsion unit to lower boat speed which, in view of engine size, could not otherwise be achieved. For high speeds, such as for water skiing, the trolling plate is retracted to a raised, horizontal position. When so raised, a trolling plate is typically located in a plane above a plane containing the anti-cavitation plate of the propulsion unit.

Prior art includes various types of hydrofoils such as that disclosed in U.S. Pat. No. 5,178,089 wherein the hydrofoil is attached to a lower unit of an outboard motor and has an upturned leading edge and a downturned trailing edge.

U.S. Pat. No. 5,203,275 shows a plate attached to a propulsion unit anti-cavitation plate and having a downturned trailing tab and shaped to abut the rearward surface of the lower housing of a propulsion unit.

U.S. Pat. No. 5,127,353 shows a combination trolling plate and hydrofoil with the hydrofoil attached to the anti-cavitation plate of an outboard motor or stern drive unit and shaped so as to be in abutment with the drive housing.

U.S. Pat. No. 5,493,990 issued to the present inventor discloses a combination including a hydrofoil and a trolling plate unit having an internal latch mechanism.

SUMMARY OF THE PRESENT INVENTION

The present invention is embodied within the provision of fin structure for attachment to the lower unit of an outboard motor or an outdrive to improve the performance of a recreational watercraft.

The fin structure is embodied in fins which project laterally of the outboard lower unit or outdrive and carried by a trolling plate component. The fins are located so as to be in alignment with the trolling plate proper when it is in a retracted position. Positioning of the fins in substantially coplanar fashion with a raised trolling plate contributes to watercraft performance by reducing the bow up attitude of the boat, particularly during acceleration to a speed suitable for water skiing or other recreational uses.

Important objectives of the present fin invention include providing fin structure that supplements the effect of a raised trolling plate by reducing the tendency of a boat hull to pitch up by contributing to streamlining water flowing past an anti-cavitation plate and a raised trolling plate thereby reducing the time from start to planing of a boat hull; the provision of fin structure which lends itself to selective use, i.e., readily attachable or removable from a mount in place on a propulsion unit for another accessory to preclude further modification of an anti-cavitation plate.

DETAILED DESCRIPTION OF THE PREFERRED EMBODIMENTS

Figures 1, 2, 3, 4:
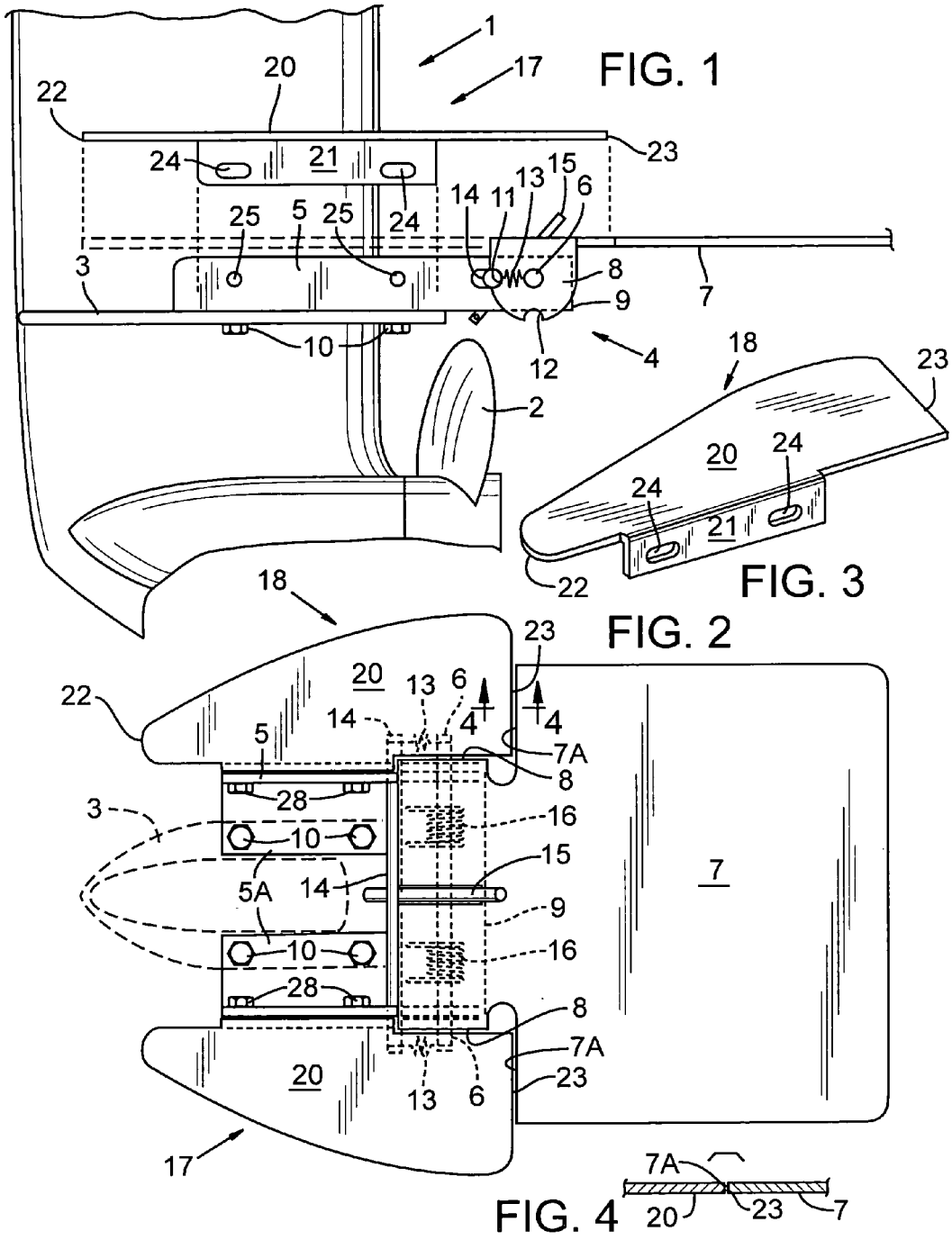
FIG. 1 is a fragmentary exploded view of an outdrive or outboard lower unit and the present fin structure.
FIG. 2 is a plan view of FIG. 1 on a reduced scale with the fin structure assembled and attached to the mounting plate of a trolling unit.
FIG. 3 is a perspective view of a fin apart from mounting structure.
FIG. 4 is a sectional view taken along line 4—4 of FIG. 2 showing the close proximity of trailing and leading edges of a fin and a trolling plate.

With further attention to the accompanying drawings wherein applied reference numerals indicate parts similarly hereinafter identified, the reference numeral 1 indicates generally an outdrive or lower unit of an outboard motor having a propeller 2. It will be understood that the present invention is not limited to propeller propulsion units, but rather may be utilized in other types of propulsion units found on small watercraft. Typical of outdrives and outboard lower units is an anti-cavitation plate 3. A trolling plate assembly or unit generally at 4 is in typical fashion mounted to an anti-cavitation plate 3 at 3 by a U-shaped bracket 5 and fasteners 10. Bracket 5 terminates rearwardly at 9. Arms 5A of the U-shaped bracket are located astride the outdrive or lower unit 1 of a propulsion unit and are of right angle section and receive an axle 6. Axle 6 serves to pivotally join a trolling plate at 7 to the mounting bracket with the forward end segment of plate 7 having a pair of ears at 8 formed thereon to receive axle 6. Detents 11 and 12 in the ears serve, along with a lock 14, respectively to maintain trailing plate 7 horizontal or vertical in an operative position to obstruct the discharge flow from propeller 2 reducing propeller efficiency and hence boat speed. Springs as at 13 bias lock 14 into detent 11 to maintain the trolling plate in the elevated position shown. A latch 15 is pivotally mounted at its lower end and is coupled to a control (not shown) for advancing the lock forward to unseat lock 14 from detent 11 permitting the plate to move to the vertical in response to torsion springs as at 16. Trolling plates, as described above, are well known, having been in use for many years.

With attention to the present fin construction for use in combination with the trolling plate unit, the fins generally at 17 and 18 are a mirror image of one another and each includes a planar portion 20 and a flange portion 21. A leading edge and a trailing edge of each fin are indicated respectively at 22 and 23. Elongate openings are at 24 for alignment with fastener receiving openings 25 in bracket arm members 5A of the mounting bracket. With each fin structure in place as attached by fastener assemblies 28, the planar portion 20 will be in alignment with trolling plate 7 per FIG. 4. With further attention to FIG. 4, it will be seen that the trailing edge 23 of each fin will be in close proximity to a leading edge 7A of trolling plate 7 and minimizes turbulence of water flowing along the top and bottom surfaces of planar portions 20 and thence along trolling plate 7.

While I have shown but one embodiment of the invention, it will be apparent to those skilled in the art that the invention may be embodied still otherwise without departing from the spirit and scope of the claimed invention.

Having thus described the invention, what is desired to be secured by a Letters Patent is.

I claim:

1. In combination, a trolling plate unit having a mounting bracket with arms angular in section for opposed attachment to a watercraft propulsion unit, a trolling plate pivotally mounted on said bracket and when in a raised position having a leading edge, fins each having a planar component and each mounted individually on said bracket arms and each of said fins having a trailing edge, and said planar component of said fins and said trolling plate being in alignment when the trolling plate is in a raised position to reduce upward pitching of the watercraft.

2. The combination claimed in claim 1 wherein said fins include a flange, fasteners extending through said flange for detachable engagement with the mounting bracket arms.

3. The combination claimed in claim 1 wherein said trolling plate leading edge and said fin trailing edge are proximate each other when the trolling plate is in a raised position.

4. The combination claimed in claim 1 wherein said fins each have a leading edge offset from said trolling plate mounting bracket in the direction of travel of the propulsion unit.

* * * * *